US008952882B2

(12) United States Patent
Lin et al.

(10) Patent No.: US 8,952,882 B2
(45) Date of Patent: Feb. 10, 2015

(54) METHOD FOR ADJUSTING A BACKLIGHT OF A DISPLAY DEVICE AND DEVICE THEREOF

(75) Inventors: Yu-Ju Lin, Hsin-Chu (TW); Ming-Fon Chien, Hsin-Chu (TW); Yu-Chun Tsai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 337 days.

(21) Appl. No.: 13/427,910

(22) Filed: Mar. 23, 2012

(65) Prior Publication Data

US 2012/0287172 A1 Nov. 15, 2012

(30) Foreign Application Priority Data

May 10, 2011 (TW) ..... 100116320 A

(51) Int. Cl.
*G09G 3/36* (2006.01)
*G09G 3/34* (2006.01)

(52) U.S. Cl.
CPC ..... *G09G 3/3426* (2013.01); *G09G 2320/0626* (2013.01); *G09G 2360/16* (2013.01)
USPC ..... 345/102

(58) Field of Classification Search
CPC ..... G09G 3/34; G09G 3/36
USPC ..... 345/102; 362/97.1, 97.2, 346
See application file for complete search history.

(56) References Cited

U.S. PATENT DOCUMENTS

| | | | | |
|---|---|---|---|---|
| 7,537,357 | B2 | 5/2009 | Jung | |
| 7,825,893 | B2 | 11/2010 | Oka | |
| 7,855,725 | B2 | 12/2010 | Huang | |
| 2008/0007509 | A1* | 1/2008 | Lankhorst et al. | 345/102 |
| 2010/0033497 | A1* | 2/2010 | Ueno et al. | 345/611 |
| 2011/0037785 | A1* | 2/2011 | Shiomi | 345/690 |

FOREIGN PATENT DOCUMENTS

| | | | |
|---|---|---|---|
| CN | 101162573 | A | 4/2008 |
| CN | 101211537 | A | 7/2008 |
| CN | 101295486 | A | 10/2008 |
| CN | 101739973 | A | 6/2010 |
| TW | I253048 | | 4/2006 |
| TW | 200915285 | | 4/2009 |

* cited by examiner

*Primary Examiner* — Pegeman Karimi
(74) *Attorney, Agent, or Firm* — Winston Hsu; Scott Margo

(57) ABSTRACT

Adjust a backlight of a display device according to image loading and edge statistics of an input image. When the input image is a dark scene and includes relatively more edges, a luminance of the backlight would be controlled according to the image loading of the input image and compensated the backlight for showing details of the input image clearly. When the input image is a dark scene with negligible edges, the luminance of the backlight would be controlled by image loading with no or few compensation for lowering the power consumption. When the input image is a bright scene, or when the input image includes no edge or only negligible edges, minimum compensation is applied to the backlight for lowering the power consumption.

16 Claims, 8 Drawing Sheets

METHOD FOR ADJUSTING A BACKLIGHT OF A DISPLAY DEVICE AND DEVICE THEREOF

BACKGROUND OF THE INVENTION

1. Field of the Invention

The present invention is related to a method for adjusting a backlight of a display device, and more particularly, to a method for adjusting a backlight of a display device according to image loading and edge statistics of an input image.

2. Description of the Prior Art

A conventional display device utilizes dynamic backlight control as a measure for lowering power consumption. Dynamic backlight control adjusts backlight luminance according to image loading of a display image. For instance, the image loading of a display image usually means an average grayscale of the display image.

Please refer to FIG. 1. FIG. 1 is a diagram illustrating the conventional display device adjusting backlight luminance utilizing dynamic backlight control when the display image is a dark scene. Since the display image is a dark scene, the display image comprises relatively low image loading. Therefore, when displaying the display image, the display device reduces the backlight luminance from a default 100% (curve C) to 30% (curve C'), as shown in FIG. 1, for lowering power consumption. Assuming the display image includes an object, and the object is between a grayscale of 100 and 150, a corresponding dynamic range Dr is approximately between a luminance of 70 and 200. After the backlight is adjusted through dynamic backlight control, the dynamic range Dr is approximately compressed to a dynamic range Dr' with a luminance of 23 to 66. A low dynamic range means less precision in intensities represented by each pixel, i.e. details of the object may not be fully presented. Therefore, for the conventional display device utilizing only image loading to adjust backlight luminance, when the display image is a dark scene and includes an object, the adjusted backlight luminance may be too low, so details of the object cannot be fully presented, consequently affecting quality of the display image.

SUMMARY OF THE INVENTION

An embodiment of the present invention discloses a method for adjusting a backlight of a display device. The method comprises generating a first backlight adjusting variable according to an image loading of an input image, generating a second backlight adjusting variable by performing edge detection to the input image, and adjusting the backlight of the display device according to the first backlight adjusting variable and the second backlight adjusting variable.

Another embodiment of the present invention further discloses a display device. The display device comprises a display panel, a light source, a light source controller and an image analyzer. The light source is disposed on one side of the display panel and utilized as a backlight of the display panel. The light source controller is electrically connected to the light source. The image analyzer generates a first backlight adjusting variable according to an image loading of an input image, and performs edge detection to the input image for generating a second backlight adjusting variable. The light source controller adjusts the light source according to the first backlight adjusting variable and the second backlight adjusting variable.

Another embodiment of the present invention further discloses a display device. The display device comprises a display panel, a light source and a light source controller. The display panel is for displaying a first input image and a second input image. The first input image comprises a first edge statistic and a first image loading, and the second input image comprises a second edge statistic and a second image loading. The light source is disposed on one side of the display panel and utilized as a backlight of the display panel. The light source controller is electrically connected to the light source for controlling the light source. When the display panel displays the first input image the light source outputs a first luminance. When the display panel displays the second input image the light source outputs a second luminance. If the first image loading equals the second image loading, and the first edge statistic is different from the second edge statistic, the first luminance is different from the second luminance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
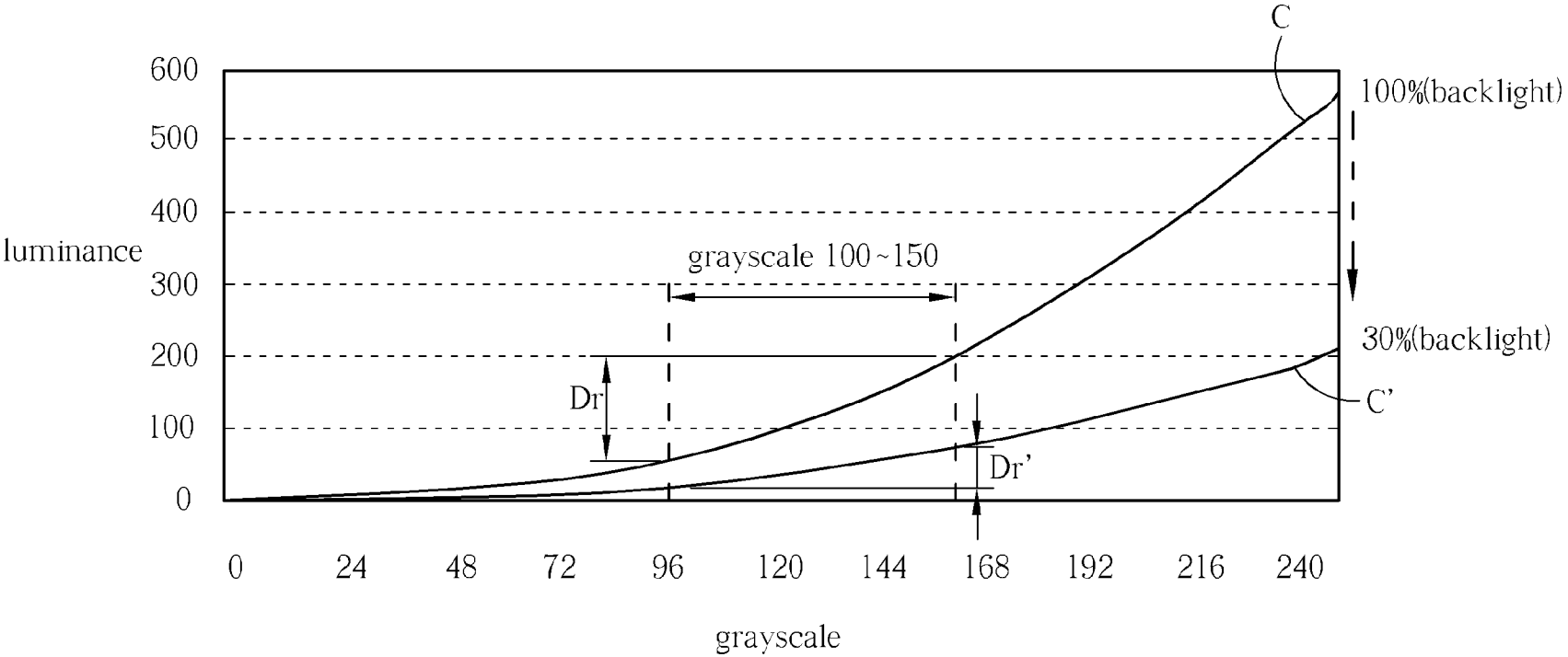
FIG. 1 PRIOR ART
FIG. 1 is a diagram illustrating a conventional display device adjusting backlight luminance utilizing dynamic backlight control, when the display image is a dark scene.

Hereinafter, preferred embodiments of a method for adjusting a backlight of a display device and devices thereof of the present invention will be described in detail with reference to the accompanying drawings. Here, it is to be noted that the present invention is not limited thereto. Furthermore, step reference numerals are not meant to limit operating sequence, and any rearrangement of the operating sequence that achieves the same functionality is still within the spirit and scope of the present invention.

Figure 2:
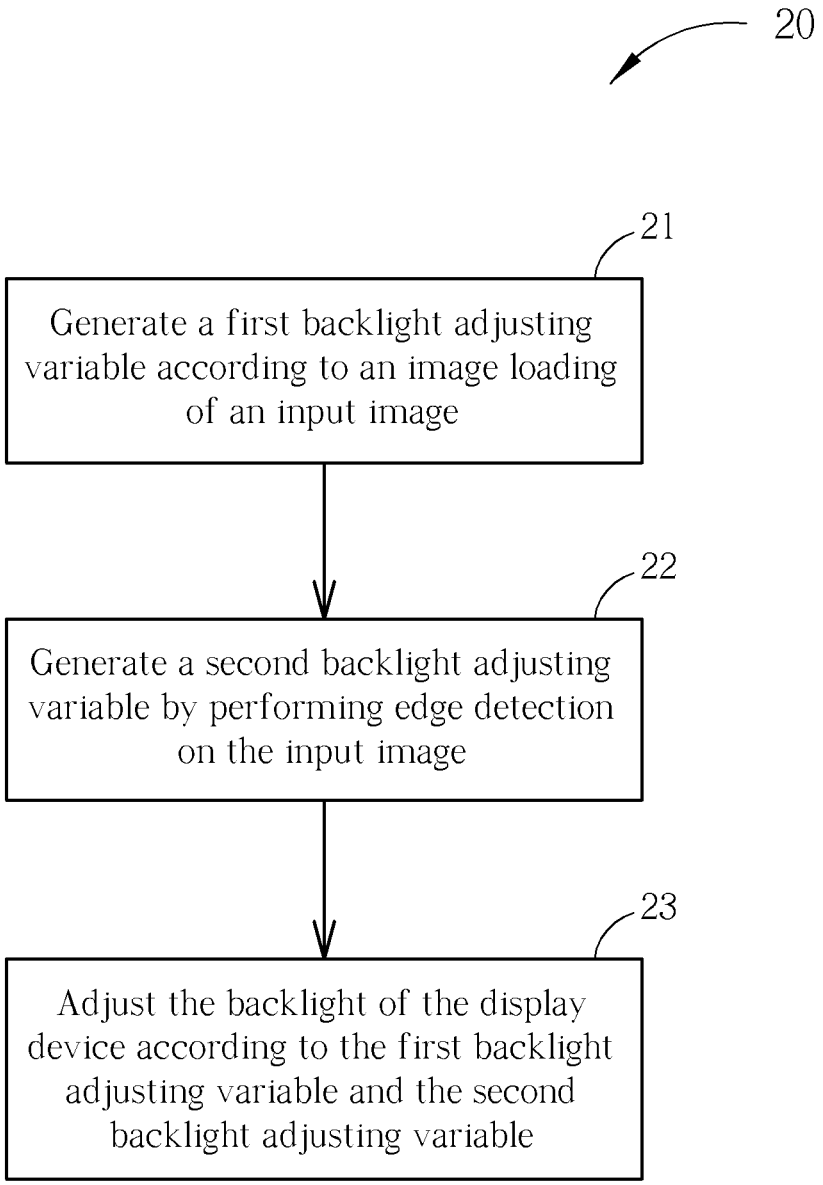
FIG. 2 is a flow chart of a method for adjusting a backlight of a display device of the present invention.

Please refer to FIG. 2. FIG. 2 is a flow chart of a method 20 for adjusting a backlight of a display device of the present invention.

Steps of the method 20 include:

Step 21: generating a first backlight adjusting variable according to an image loading of an input image;

Step 22: generating a second backlight adjusting variable by performing edge detection to the input image; and Step 23: adjusting the backlight of the display device according to the first backlight adjusting variable and the second backlight adjusting variable.

In step 21, the first backlight adjusting variable corresponds to the image loading of the input image. For instance, the first backlight adjusting variable can be calculated according to formula (1).

$$BLavg = \frac{Gavg}{Gmax} \tag{1}$$

In formula (1), BLavg is the first backlight adjusting variable, Gavg is the image loading of the input image and Gmax corresponds to a maximum grayscale of the grayscale range of the input image. Taking an 8-bit input image as an example, the corresponding grayscale range is 0-255, meaning the maximum grayscale Gmax is 255.

In step 23, a variable BLc is generated according to formula (2), and the display device adjusts backlight according to the variable BLc.

$$BLc = BL\text{avg} + (1 - BL\text{avg}) \times w \tag{2}$$

where w is the second backlight adjusting variable. The second backlight adjusting variable w corresponds to edge statistics of the input image. For instance, the second backlight adjusting variable can change according to a number of edges corresponding to each grayscale of the input image, for adjusting the variable BLc.

When the input image is a low grayscale scene such as a dark scene, the first backlight adjusting variable BLavg of the corresponding image loading is relatively low, which lowers the variable BLc for the display device to output backlight of reduced luminance. Consequently, if the input image includes edges, details of the input image may be blurred or even disappear. Therefore, a purpose of the second backlight adjusting variable w is to compensate the variable BLc so the backlight luminance is increased when the input image is a low grayscale scene and includes edges, for preventing edge details of the input image from severe distortion.

In the present embodiment, the second backlight adjusting variable w can be calculated from formula (3).

$$w = \sum_{g} \left[ P(g) \times \frac{H^{m}(g)}{EC} \right] \times Hstr \tag{3}$$

where g is a grayscale value, H(g) is an edge statistic corresponding to the grayscale value g, P(g) is a weighting corresponding to the grayscale value g, EC is a sample size of the edge statistic H (g), Hstr is a first variable and m is a second variable. According to formula (3), the second backlight adjusting variable w sums from a lowest grayscale value g to a highest value grayscale value g.

Figure 3:
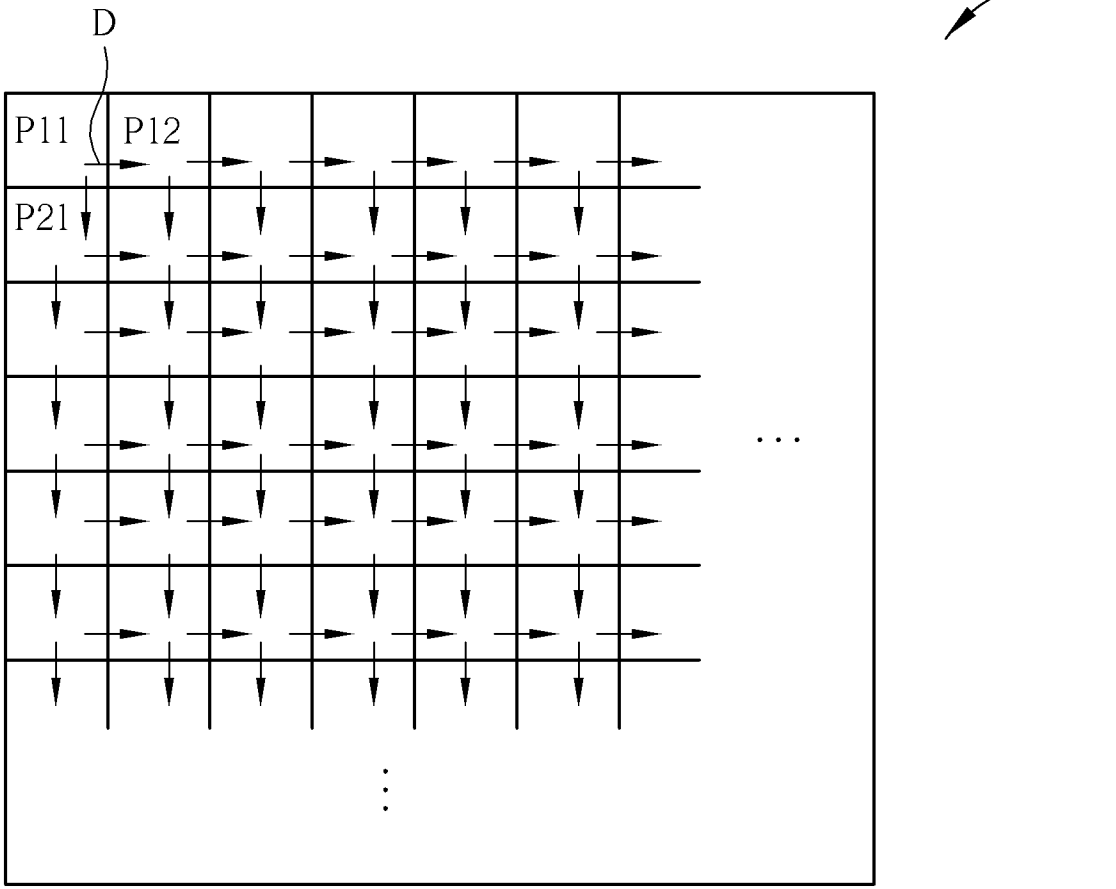
FIG. 3 is a diagram illustrating performing edge detection to an input image from a grayscale difference between neighboring pixels according to an embodiment of the present invention.
Figure 4:
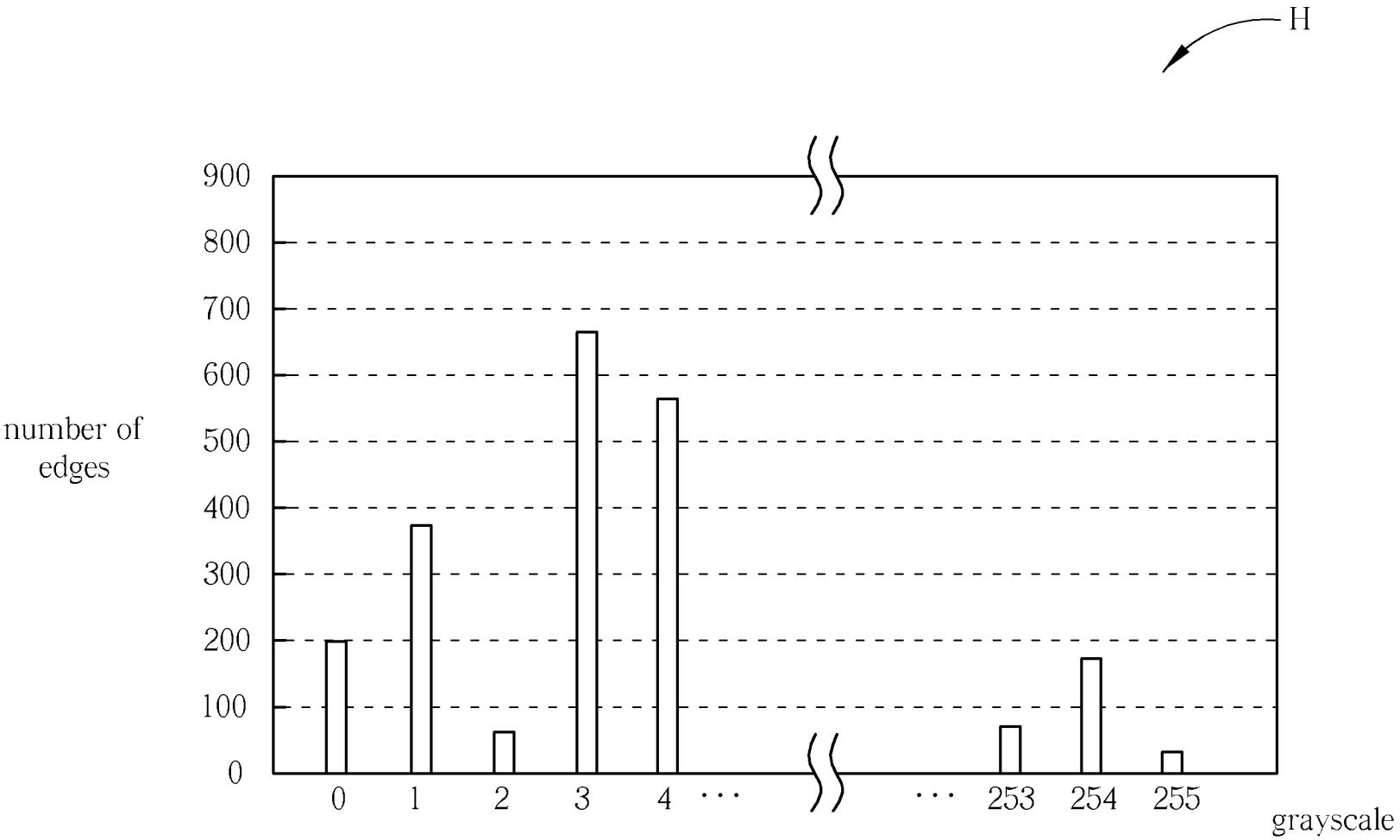
FIG. 4 is a diagram illustrating the edge statistic corresponding to each grayscale in the input image according to an embodiment of the present invention.

In the present embodiment, the edge detection is performed according to a difference of grayscale values between neighboring pixels in the input image. Please refer to FIG. 3 and FIG. 4. FIG. 3 is a diagram illustrating performing edge detection on an input image I from the difference between grayscale values of neighboring pixels according to an embodiment of the present invention. FIG. 4 is a diagram illustrating the edge statistic corresponding to each grayscale in the input image according to an embodiment of the present invention.

As shown in FIG. 3, an arrow symbol indicates an action of comparing grayscales. Taking a pixel P11 as an example, the pixel P11 compares grayscales with a neighboring pixel P12 or P21. If a grayscale difference D between the pixel P11 and one neighboring pixel is larger than a predetermined threshold value, an edge is determined to exist between the pixel P11 and the one neighboring pixel. In FIG. 3, the action of comparing grayscales is not limited to directions of the arrows—as long as each pixel of the input image I can be compared to respective neighboring pixels.

The above mentioned threshold value can be adjusted according to grayscale values of the pixels being compared. For instance, if grayscale value of the pixel P11 is 20 and grayscale value of the neighboring pixel P12 is 30, the grayscale difference D is 10. Since grayscale values of the pixels P11 and P12 are relatively low, the threshold value is also relatively low, such as 5. Since the grayscale difference D is 10 and the threshold value is 5, the grayscale difference D is larger than the threshold value, so an edge is determined to exist in pixels P11 and P12.

On the other hand, if grayscale value of the pixel P11 is 200 and grayscale value of the neighboring pixel P12 is 210, the grayscale difference D is still 10. However, since grayscale values of the pixels P11 and P12 are relatively high, the threshold value is also relatively high, such as 20. Since the grayscale difference D is 10 and the threshold value is 20, the grayscale difference D is not larger than the threshold value, so no edges are determined to exist in pixels P11 and P12. The relation between the threshold value and grayscale values of the pixels being compared are predetermined, such as saved in a look-up table.

When the grayscale difference between the first pixel (e.g. pixel P11) and a neighboring second pixel (e.g. pixel P12) is larger than the threshold value, edge statistics corresponding to the grayscales of the first pixel and the second pixel are increased as shown in FIG. 4. In the present embodiment, the edge statistics are represented in a histogram H. As shown in FIG. 4, the X-axis of the histogram H corresponds to grayscale values, the Y-axis of the histogram H corresponds to a number of edges and the histogram H records the number of edges corresponding to each grayscale of the input image. Taking the input image I in FIG. 3 as an example, if the grayscale of the pixel P11 is 20, the grayscale of the neighboring pixel P12 is 30, and the grayscale difference D between pixels P11 and P12 is larger than the threshold value, numbers of edges corresponding to grayscale values of 20 and 30 are increased in the histogram H of FIG. 4. The histogram H in FIG. 4 is only an exemplary embodiment, and the method 20 of the present invention is not limited to utilizing a histogram to represent the edge statistics of each grayscale value in the input image.

In another embodiment, an upper limit such as 220 or 240 is predetermined. If the grayscale difference D between the pixels P11 and P12 is larger than the upper limit, meaning the grayscale difference D is significant (such as edges of a grid in a checkerboard pattern), human eyes can perceive the grayscale difference between the pixels P11 and P12 clearly without requiring adjusting the backlight luminance to enhance the details. Therefore, if the grayscale difference D between the pixels P11 and P12 is larger than the upper limit, meaning the grayscale difference D between the pixels P11 and P12 far exceeds the threshold value, the number of edges corresponding to grayscale values of pixels P11 and P12 is not increased in the histogram H of FIG. 4. If the grayscale difference D between the pixels P11 and P12 is between the threshold value and the upper limit, the number of edges corresponding to grayscale values of the pixels P11 and P12 is then increased respectively in the histogram H of FIG. 4. This way, the present invention can exclude edges that are obvious to human eyes, and more accurately determine grayscales corresponding to edges that require backlight adjustment in the input image I.

After edge detection is performed on each pixel of the input image I in FIG. 3, the edge statistics corresponding to each pixel, such as the histogram H in FIG. 4, can be obtained. For instance, in formula (3), H(1) indicates the edge statistic of a number of edges corresponding to a grayscale value g of 1.

Please refer to formula (3) again:

$$w = \sum_g \left[ P(g) \times \frac{H^m(g)}{EC} \right] \times Hstr \tag{3}$$

In formula (3), the variable EC indicates a sample size for calculating the edge statistic H(g). For instance, in FIG. 3 each pixel of the input image I compares grayscale with two neighboring pixels. If a resolution of the input image I is 1920×1080, the action of comparing grayscales is then performed 1920×1080×2 times, hence the variable EC is 1920×1080×2.

In formula (3), P(g) is the weighting corresponding to the grayscale value g for assigning a lower grayscale with a higher weighting. In other words, a higher grayscale value g corresponds to a lower weighting P(g), and a lower grayscale value g corresponds to a higher weighting P(g), and vice versa. For instance, when the grayscale value g is 1, 2, 3 . . . 255, the corresponding weighting P(g) may be 255, 254, 253 . . . 1 respectively.

When an edge is detected in the input image I, sufficient backlight luminance is required to present the corresponding detail of the input image I. The first variable Hstr and the second variable m add emphasis on how details of the input image I affect the backlight luminance. If the input image I includes edges, a value of the edge statistic H(g) is relatively high, and the first variable Hstr and the second variable m can greatly increase the second backlight adjusting variable w for increasing the backlight luminance to maintain details of the input image. If the input image I includes no or negligible edges, the value of the edge statistic H(g) is relatively low, and the first variable Hstr and the second variable m do not increase the second backlight adjusting variable w much, so the backlight luminance is barely affected. In the present embodiment, the first variable Hstr and the second variable m can be natural numbers, such as natural numbers that are equal to or greater than 2. In another embodiment, the first variable Hstr and the second variable m can both be 1, meaning that when the input image is a dark scene and includes edges, less backlight luminance is compensated but the power consumption is also lowered. The first variable Hstr and the second variable m can be adjusted according to practical demands. The second variable m is not limited to being the exponential of H(g). In another embodiment, the second variable m can be the exponential of $$\left(\frac{H(g)}{EC}\right)$$

in the formula (3), as shown in formula (4).

$$w = \sum_g \left[ P(g) \times \left(\frac{H(g)}{EC}\right)^m \right] \times Hstr \tag{4}$$

When the input image is a low grayscale scene and includes edges, the first backlight adjusting variable BLavg is relatively low and values of the weighting P (g) and the edge statistic H (g) are relatively high, so the second backlight adjusting variable w is also relatively high. Therefore, a value of the (1−BLavg)×w part of the formula (2) is relatively high for compensating the variable BLc with a greater magnitude. As a result, details of the input image are maintained from the backlight luminance compensation.

When the input image is a high grayscale scene (e.g. a bright scene) and includes edges, the first backlight adjusting variable BLavg is relatively high, the weighting P(g) is relatively low and the edge statistic H(g) is relatively high, so the second backlight adjusting variable w is relatively low. Therefore, a value of the (1−BLavg)×w part of the formula (2) is relatively low and little adjustment is performed on the variable BLc, so the backlight luminance is barely affected.

When the input image is a low grayscale scene (e.g. a dark scene) and includes no or negligible edges, the first backlight adjusting variable BLavg is relatively low, the weighting P(g) is relatively high and the edge statistic H(g) is relatively low, so the second backlight adjusting variable w is relatively low. Therefore, a value of the (1−BLavg)×w part of the formula (2) is relatively low and little adjustment is performed on the variable BLc, so the backlight luminance is hardly affected. In other words, in the present embodiment, when the input image is not a low grayscale scene and the input image includes no or negligible edges, the second backlight adjusting variable w is relatively low, so the variable BLc almost equals the first backlight adjusting variable BLavg.

Therefore, according to the method of the present invention, when the input image is a low grayscale scene and includes relatively more edges, the backlight luminance can be compensated for showing details of the input image clearly. When the input image is a dark scene, or when the input image includes no or negligible edges, the method of the present invention does not affect the backlight luminance much, hence lowering the power consumption.

Figure 5:
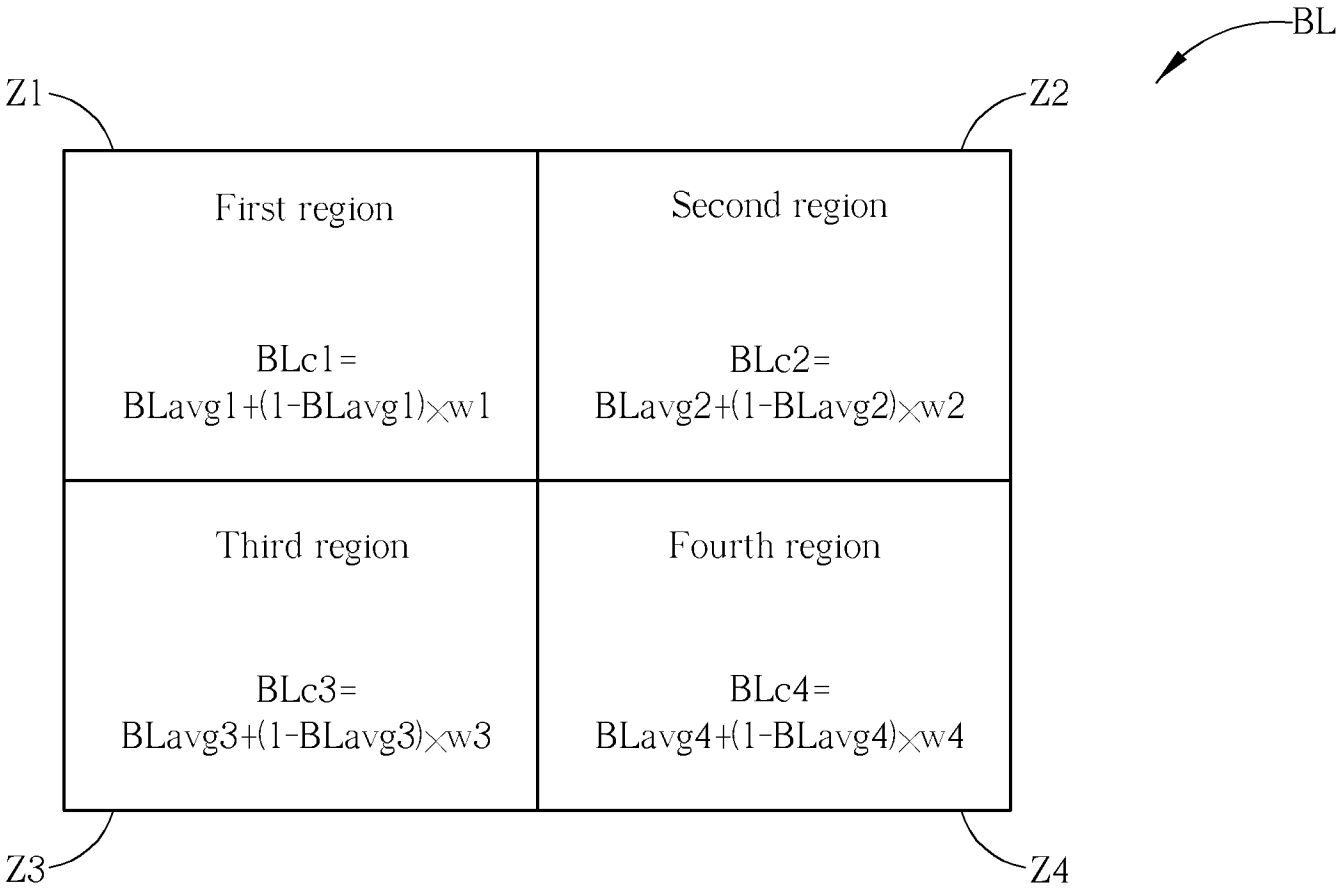
FIG. 5 is a diagram illustrating the method for adjusting backlight of each region of a display device of the present invention.

Please refer to FIG. 5. FIG. 5 is a diagram illustrating the method of the present invention for adjusting backlight of each region of a display device; however ways to divide regions and a number of regions being divided are not limited to the embodiment shown in FIG. 5. In FIG. 5, a backlight BL of the display device comprises a first region Z1, a second region Z2, a third region Z3 and a fourth region Z4. The present invention can calculate backlight compensation for each region according to a first backlight adjusting variable and a second backlight adjusting variable corresponding to each region. For instance, variables BLc1, BLc2, BLc3 and BLc4 are generated according to formulae (a), (b), (c) and (d) respectively, for the display device to adjust backlight of the first region Z1, the second region Z2, the third region Z3 and the fourth region Z4 respectively.

$$BLc1 = BLavg1 + (1 - BLavg1) \times w1 \tag{a}$$

$$BLc2 = BLavg2 + (1 - BLavg2) \times w2 \tag{b}$$

$$BLc3 = BLavg3 + (1 - BLavg3) \times w3 \tag{c}$$

$$BLc4 = BLavg4 + (1 - BLavg4) \times w4 \tag{d}$$

where BLavg1 is the first backlight adjusting variable of the first region Z1, and corresponds to an image loading of the first region Z1, BLavg2 is the first backlight adjusting variable of the second region Z2, and corresponds to an image loading of the second region Z2, and so on. w1 is the second backlight adjusting variable of the first region Z1, w2 is the second backlight adjusting variable of the second region Z2, and so on.

The first backlight adjusting variables BLavg1, BLavg2, BLavg3 and BLavg4 are calculated according to "an image loading of the input image" and "a maximum grayscale of the grayscale range of the input image" corresponding to each region, similar to the principle of the formula (1). The second backlight adjusting variables w1, w2, w3 and w4 are calculated according to edge statistics corresponding to each region of the input image, similar to the principle of the formula (3).

For instance, when the first backlight adjusting variable BLavg1 (e.g. image loading) of the first region Z1 is the same as those of the second region Z2, the third region Z3 and the fourth region Z4, if the input image of the first region Z1 includes relatively more edges, the second backlight adjusting variable w1 of the first region Z1 will be higher than the second backlight adjusting variables of the second region Z2, the third region Z3 and the fourth region Z4. Therefore, the display device adjusts backlight output, for backlight luminance corresponding to the first region Z1 to be higher than those of the second region Z2, the third region Z3 and the fourth region Z4. As a result, better image quality, wider dynamic range and lower power consumption can be achieved by adjusting backlight of each region according to characteristics of each respective region.

Figure 6:
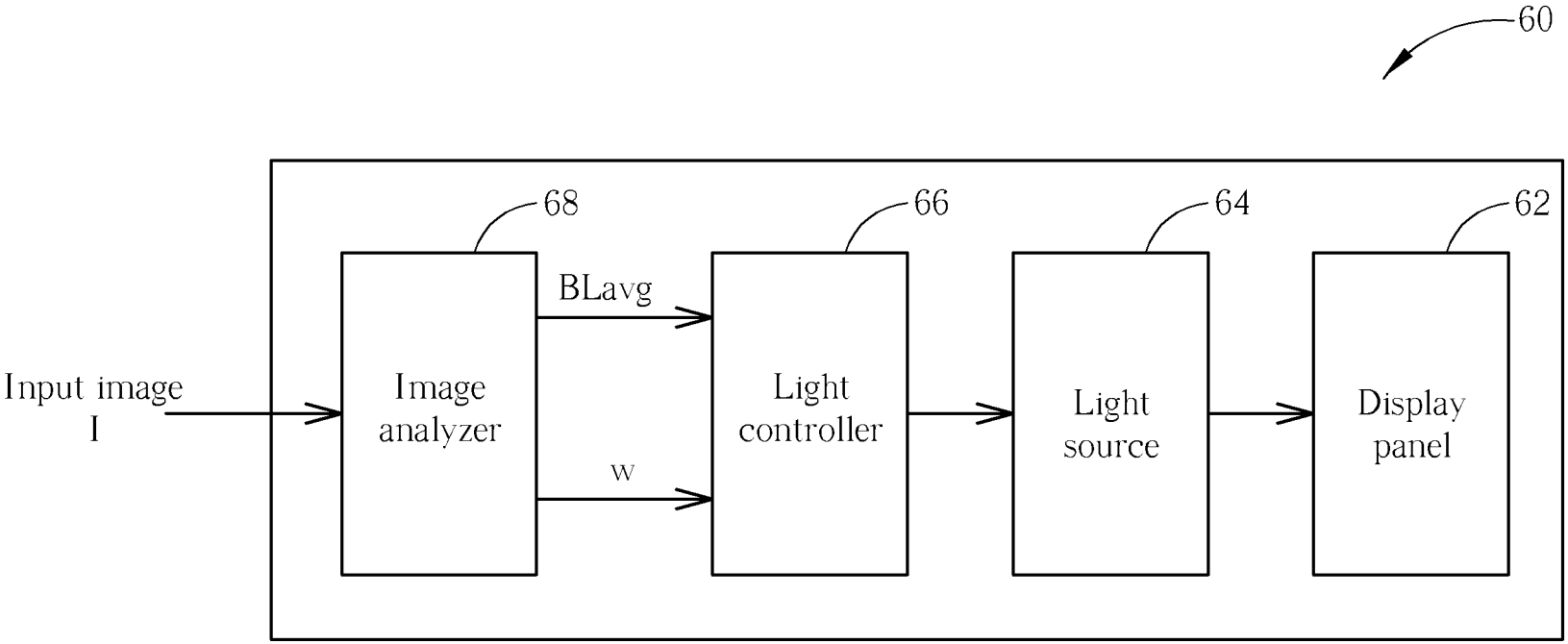
FIG. 6 is a diagram illustrating a display device according to an embodiment of the present invention.

Please refer to FIG. 6. FIG. 6 is a diagram illustrating a display device 60 according to an embodiment of the present invention. The display device 60 comprises a display panel 62, a light source 64, a light source controller 66 and an image analyzer 68. The light source 64 is utilized as a backlight of the display panel 62. The light source 64, for instance, can be a cold-cathode fluorescent lamp (CCFL), a hot-cathode fluorescent lamp (HCFL) or a light-emitting diode (LED), etc. Architecture of the light source 64 can be a direct type or an edge type, etc. The light source controller 66 is electrically connected to the light source 64. The image analyzer 68 generates a first backlight adjusting variable BLavg according to an image loading of an input image I, and performs edge detection on the input image I for generating a second backlight adjusting variable w. The light source controller 66 adjusts the light source 64 according to the first backlight adjusting variable BLavg and the second backlight adjusting variable w. Principles of how the image analyzer 68 generates the first backlight adjusting variable BLavg and the second backlight adjusting variable w, and how the light source controller 66 adjusts the light source 64 according to the first backlight adjusting variable BLavg and the second backlight adjusting variable w are similar to the method 20, and the formulae (1), (2) and (3), so relative descriptions are omitted hereinafter.

When adjusting the backlight of a region of the display device, for instance, if the display panel 62 comprises a first region Z1, a second region Z2, a third region Z3 and a fourth region Z4 as shown in FIG. 5, the image analyzer 68 generates the first backlight adjusting variable of each region according to the image loading of the input image corresponding to each region. The image analyzer 68 performs edge detection on the input image corresponding to each region for generating the second backlight adjusting variable corresponding to each region. The light source controller 66 adjusts the light source 64 corresponding to each region according to the respective first backlight adjusting variable and the respective second backlight adjusting variable of each region.

Figure 7:
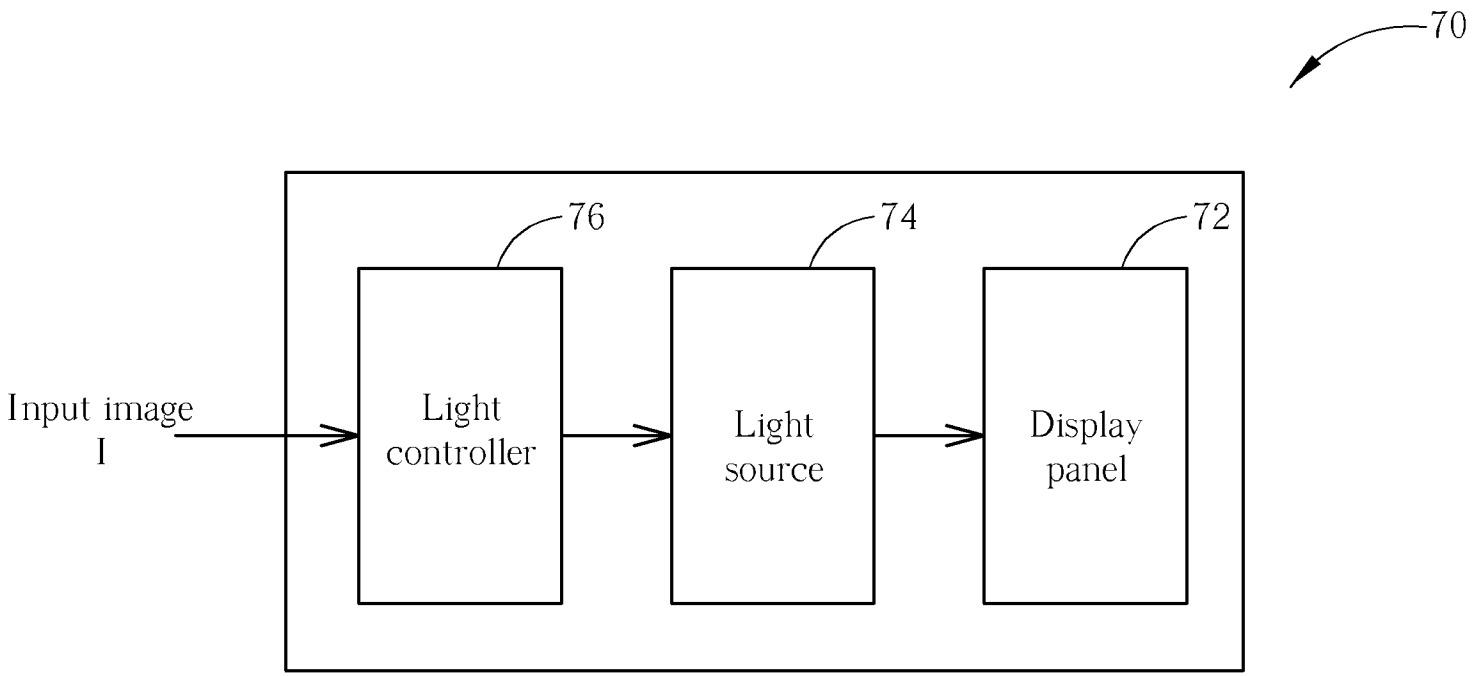
FIG. 7 is a diagram illustrating a display device according to another embodiment of the present invention.
Figure 8:
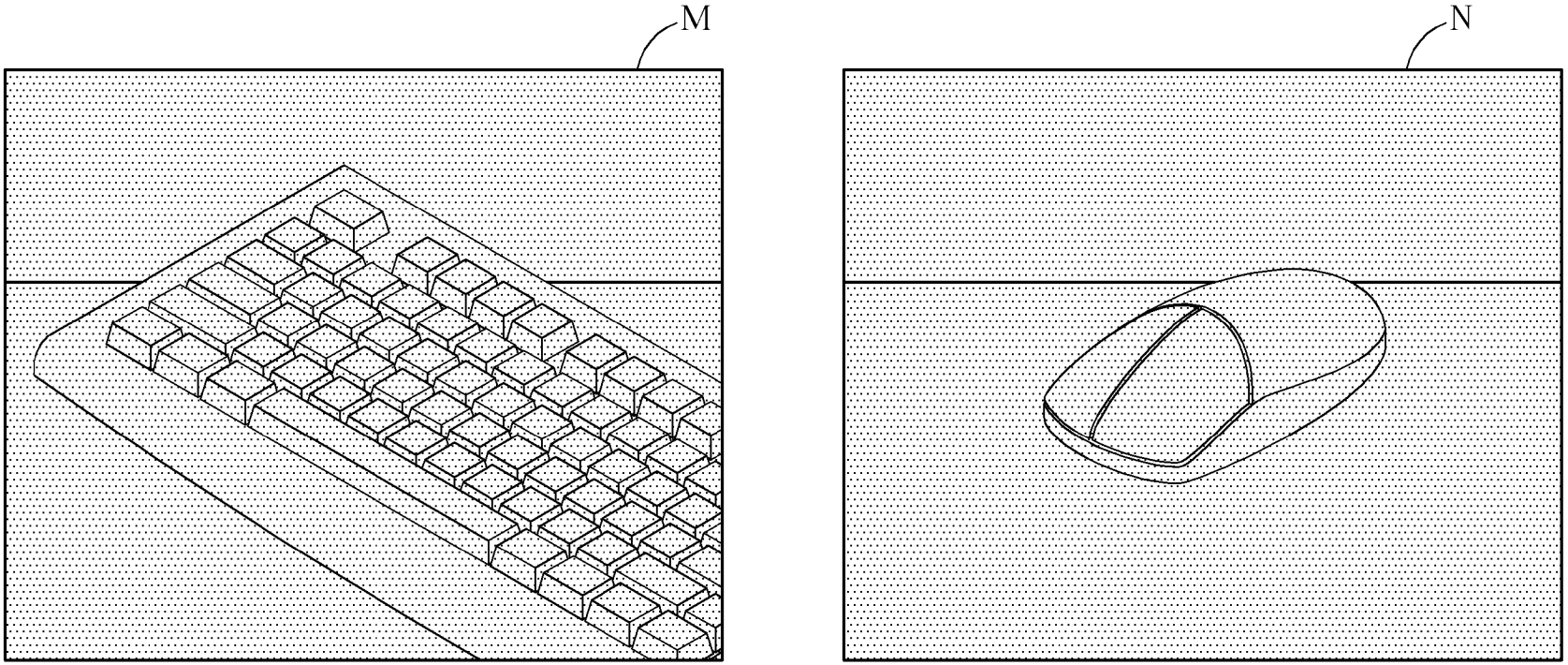
FIG. 8 is a diagram illustrating two input images with similar image loadings and different edge statistics.

Please refer to FIG. 7 and FIG. 8 at the same time. FIG. 7 is a diagram illustrating a display device 70 according to another embodiment of the present invention. FIG. 8 is a diagram illustrating two input images with similar image loadings and different edge statistics. In FIG. 7, the display device 70 comprises a display panel 72, at least one light source 74 and a light source controller 76. The light source 74 is utilized as a backlight of the display panel 72. The light source controller 76 is electrically connected to the light source 74, for controlling the light source 74.

In FIG. 8, a first input image M comprises a first edge statistic and a first image loading, and the second input image N comprises a second edge statistic and a second image loading. When the display panel 72 displays the first input image M and the second input image N, the light source 74 outputs a first luminance and a second luminance respectively. As shown in FIG. 8, the first input image M and the second input image N are scenes with similar luminance, meaning the first image loading approximately equals to the second image loading. However, the first input image M (e.g. including a keyboard) includes more edges than the second input image N (e.g. including a mouse), so the first edge statistic is greater than the second edge statistic. When the first image loading approximately equals the second image loading and the first edge statistic is greater than the second edge statistic, the first luminance outputted by the light source 74 is higher than the second luminance. In other words, when two input images have similar image loadings, the display device 70 performs greater backlight compensation on the input image with more edges (e.g. the input image with a larger edge statistic), for showing details of the input image clearly. On the other hand, the display device 70 performs little backlight compensation on the input image with fewer edges (e.g. the input image with a smaller edge statistic), for maintaining details of the input image while taking power consumption into consideration.

The above mentioned methods and related devices are merely exemplifying embodiments of the present invention. Those skilled in the art can certainly make appropriate modifications according to practical demands.

In conclusion, the method of the present invention adjusts a backlight of a display device according to image loading and edge statistics of an input image. When the input image is a dark scene and includes relatively more edges, a luminance of the backlight is compensated for showing details of the input image clearly. When the input image is a bright scene, or when the input image includes no edges or includes negligible edges, minimum compensation is applied to the backlight for lowering the power consumption. As a result, by adjusting backlight luminance according to image loading and edge statistic of the input image, the dynamic range can be increased for improving the image quality, and the power consumption can be lowered at the same time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for adjusting a backlight of a display device, comprising:

generating a first backlight adjusting variable according to an image loading of an input image;

generating a second backlight adjusting variable by performing edge detection on the input image according to a grayscale difference between neighboring pixels in the input image; and adjusting the backlight of the display device according to a value of "the second backlight adjusting variable multiplied by a complement of the first backlight adjusting variable, and then added to the first backlight adjusting variable".

2. The method of claim 1, wherein generating the second backlight adjusting variable according to the grayscale difference between the neighboring pixels in the input image comprises:

determining whether the grayscale difference between a first pixel and a neighboring second pixel of the input image is larger than a predetermined threshold value;

if the grayscale difference is larger than the threshold value, increasing statistics corresponding to grayscales of the first pixel and the second pixel; and generating the second backlight adjusting variable according to the statistics corresponding to the grayscales of the first pixel and the second pixel.

3. The method of claim 1, wherein generating the second backlight adjusting variable according to the grayscale difference between the neighboring pixels in the input image comprises:

determining whether the grayscale difference between a first pixel and a neighboring second pixel of the input image is between a predetermined threshold value and a predetermined upper limit;

if the grayscale difference is between the threshold value and the upper limit, increasing statistics corresponding to grayscales of the first pixel and the second pixel; and generating the second backlight adjusting variable according to the statistics corresponding to the grayscales of the first pixel and the second pixel.

4. The method of claim 1, wherein generating the second backlight adjusting variable by performing edge detection on the input image is according to:

$$w = \sum_{g} \left[ P(g) \times \frac{H^{m}(g)}{EC} \right] \times Hstr;$$

where w is the second backlight adjusting variable, g is a grayscale value, H(g) is an edge statistic corresponding to the grayscale value g, P(g) is a weighting corresponding to the grayscale value g, EC is a sample size of the edge statistic, Hstr is a first variable, m is a second variable, a higher g value corresponds to a lower P(g) value, and the second backlight adjusting variable sums from a lowest g value to a highest g value.

5. The method of claim 1, wherein generating the second backlight adjusting variable by performing edge detection on the input image is according to:

$$w = \sum_{g} \left[ P(g) \times \left( \frac{H(g)}{EC} \right)^{m} \right] \times Hstr;$$

where w is the second backlight adjusting variable, g is a grayscale value, H(g) is an edge statistic corresponding to the grayscale value g, P(g) is a weighting corresponding to the grayscale value g, EC is a sample size of the edge statistic, Hstr is a first variable, m is a second variable, a higher g value corresponds to a lower P(g) value, and the second backlight adjusting variable sums from a lowest g value to a highest g value.

6. The method of claim 1, wherein generating the first backlight adjusting variable according to the image loading of the input image is generating the first backlight adjusting variable according to the image loading corresponding to an input image of a region of the display device, generating the second backlight adjusting variable by performing edge detection on the input image is generating the second backlight adjusting variable by performing edge detection on the input image corresponding to the region, and adjusting the backlight of the display device according to the first backlight adjusting variable and the second backlight adjusting variable is adjusting the backlight corresponding to the region of the display device according to the first backlight adjusting variable and the second backlight adjusting variable corresponding to the region of the display device.

7. A display device, comprising:

a display panel;

a light source disposed on one side of the display panel and utilized as a backlight of the display panel;

a light source controller electrically connected to the light source; and an image analyzer;

wherein the image analyzer generates a first backlight adjusting variable according to an image loading of an input image, and performs edge detection on the input image for generating a second backlight adjusting variable, and the light source controller adjusts the backlight of the display device according to a value of "the second backlight adjusting variable multiplied by a complement of the first backlight adjusting variable, and then added to the first backlight adjusting variable.

8. The display device of claim 7, wherein the image analyzer performing edge detection to the input image for generating the second backlight adjusting variable comprises:

generating statistics according to a grayscale difference between neighboring pixels in the input image; and generating the second backlight adjusting variable according to the statistics corresponding to the neighboring pixels.

9. The display device of claim 8, wherein the image analyzer performing edge detection on the input image for generating the second backlight adjusting variable comprises:

determining whether the grayscale difference between a first pixel and a neighboring second pixel of the input image is larger than a predetermined threshold value; and if the grayscale difference is larger than the threshold value, increasing statistics corresponding to grayscales of the first pixel and the second pixel.

10. The display device of claim 8, wherein the image analyzer performing edge detection on the input image for generating the second backlight adjusting variable comprises:

determining whether the grayscale difference between a first pixel and a neighboring second pixel of the input image is between a predetermined threshold value and a predetermined upper limit; and if the grayscale difference is between the threshold value and the upper limit, increasing statistics corresponding to grayscales of the first pixel and the second pixel.

11. The display device of claim 7, wherein:

the image analyzer generating the first backlight adjusting variable according to the image loading of the input image, is generating the first backlight adjusting variable according to the image loading of the input image of a region of the display panel;

the image analyzer performing edge detection on the input image for generating the second backlight adjusting variable, is performing edge detection on the input image of the region of the display panel for generating the second backlight adjusting variable; and the light source controller adjusting the light source according to the first backlight adjusting variable and the second backlight adjusting variable is adjusting the light source corresponding to the region of the display panel according to the first backlight adjusting variable and the second backlight adjusting variable corresponding to the region of the display panel.

12. A display device, comprising:

a display panel for displaying a first input image and a second input image, wherein the first input image comprises a first edge statistic and a first image loading, and the second input image comprises a second edge statistic and a second image loading;

a light source disposed on one side of the display panel and utilized as a backlight of the display panel; and a light source controller electrically connected to the light source for controlling the light source;

wherein when the display panel displays the first input image, the light source outputs a first luminance;

when the display panel displays the second input image, the light source outputs a second luminance; and if the first image loading equals the second image loading, and the first edge statistic is different from the second edge statistic, the first luminance is different from the second luminance.

13. The display device of claim 12, wherein when the first image loading equals the second image loading, and the first edge statistic is greater than the second edge statistic, the first luminance is higher than the second luminance.

14. The display device of claim 13, wherein the first edge statistic and the second edge statistic are generated according to a grayscale difference between neighboring pixels in the first input image and the second input image respectively.

15. The display device of claim 14, wherein generating the first edge statistic and the second edge statistic according to the grayscale difference between the neighboring pixels in the first input image and the second input image respectively comprises:

determining whether the grayscale difference between a first pixel and a neighboring second pixel of the first input image and the second input image is larger than a predetermined threshold value;

if the grayscale difference is larger than the threshold value, increasing statistics corresponding to grayscales of the first pixel and the second pixel; and generating the first edge statistic and the second edge statistic according to the statistics corresponding to the grayscales of the first pixel and the second pixel.

16. The display device of claim 14, wherein generating the first edge statistic and the second edge statistic according to the grayscale difference between the neighboring pixels in the first input image and the second input image respectively comprises:

determining whether the grayscale difference between a first pixel and a neighboring second pixel of the first input image and the second input image is between a predetermined threshold value and a predetermined upper limit;

if the grayscale difference is between the threshold value and the upper limit, increasing statistics corresponding to grayscales of the first pixel and the second pixel; and generating the first edge statistic and the second edge statistic according to the statistics corresponding to the grayscales of the first pixel and the second pixel.

* * * * *